US005319872A

United States Patent [19]

Bammate

[11] Patent Number: 5,319,872

[45] Date of Patent: Jun. 14, 1994

[54] CARTRIDGE PACKAGE FOR AUTOMATIC OR SEMIAUTOMATIC FIREARMS

[75] Inventor: Timour Bammate, Paris, France

[73] Assignee: Marianne Bammate, Paris, France

[21] Appl. No.: 996,072

[22] Filed: Dec. 23, 1992

[30] Foreign Application Priority Data

Feb. 11, 1992 [CH] Switzerland ..... 00401/92-6

[51] Int. Cl.[5] ..... F42B 39/02

[52] U.S. Cl. ..... 42/88; 42/90; 206/3; 224/196; 224/226; 224/239; 224/914

[58] Field of Search ..... 42/50, 87, 88, 90; 206/3; 224/196, 203, 224, 226, 239, 240, 914

[56] References Cited

U.S. PATENT DOCUMENTS

| | | | |
|---|---|---|---|
| 399,916 | 3/1889 | Mills | 224/224 |
| 2,732,111 | 1/1956 | Fogle | 224/203 |
| 4,027,415 | 6/1977 | Stoner | 42/50 |
| 4,442,962 | 4/1984 | Musgrave | 224/239 |

*Primary Examiner*—Stephen C. Bentley
*Attorney, Agent, or Firm*—Anthony J. Casella; Gerald E. Hespos

[57] ABSTRACT

A cartridge packing is provided for an automatic or semiautomatic firearm. The cartridge packing includes an operational loader having a magazine filled with cartridges. The operational loader and cartridges are enclosed in a protection piece for protection against shocks and pollution. The protection piece includes a rigid cap and a tearable bag.

5 Claims, 1 Drawing Sheet

CARTRIDGE PACKAGE FOR AUTOMATIC OR SEMIAUTOMATIC FIREARMS

BACKGROUND OF THE INVENTION

The object of the present invention is a cartridge packing for automatic or semiautomatic firearms comprising at least one container element filled with a given number of cartridges, and at least one closure element for said container element.

In the best-known cartridge packings today, the container element consists of a simple box and the closure element is formed of a cover which can be swung by folding or is removable by pulling out.

The cartridges are arranged in the box either loosely or in a holding element such as, for instance, a honeycomb frame.

Upon the operation of loading his firearm, the marksman manually transfers a desired number of cartridges from the boxes into the loader of the firearm before introducing the loader into it.

This transfer operation in not without drawbacks.

Equipping a loader with cartridges in fact requires careful and laborious manipulations, particularly in the case of a large capacity loader, without taking into account the fact that in the case of the latter the operation can become rather lengthy.

Upon the introduction of each cartridge into the loader, it is necessary to overcome the resistance of a spring which is contained in the loader and is applied against a piston which receives the first cartridge introduced, this while sliding the cartridge to be introduced beneath the two bent edges of the open end of the body of the loader which form retention lips for the cartridges introduced. The use of both hands is indispensable for this operation, since it is necessary to hold the loader firmly at the same time.

Due to this, the operation of filling a loader is difficult and it may happen that it escapes the hands of the marksman, particularly when the resistance of the spring is great.

In the event of this clumsiness, and depending on where and on what the loader falls, slight deformations which are not readily apparent may be produced which escape the notice of the marksman but result in consequences of greater or lesser seriousness.

Thus, for instance, the region of the first cartridge, and particularly the retaining lips of the loader which also have the function, during the firing and by their orientation, of suitably presenting each cartridge in front of the guide ramp leading to the firing chamber of the firearm, may suffer deformations which may cause the jamming of the chamber.

These difficulties in the filling of a loader and this risk of jamming of the firearm, although acceptable on training, may become critical in a combat situation.

In an attempt to improve this state of affairs, partial solutions have been proposed and placed in effect.

Thus, for example, with respect to the filling of a loader of known type, the loader is provided on a side wall with a sliding push button which is connected to the piston in order to compress the spring by the thumb of the hand which holds the loader, while a cartridge which is held between the thumb and the index finger of the other hand is slipped below the lips and introduced into the loader. This system, however, requires brief relaxation of the piston of the loader after each insertion of a cartridge in order for the cartridges to be correctly positioned; furthermore, upon this subsidiary operation, one must avoid pulling too strongly on the piston and then relaxing it suddenly, since in this way one risks damaging the lips of the loader and inevitably causing defects in the feed.

Furthermore, with regard to the filling operation, in the case of another loader of known type a storing tool has been created in the form of a slide member which can be applied to the wall of the loader and is provided with a push member which comes against the piston or a cartridge which has already been introduced can be lowered by pressing this tool against the action of the spring, and the cartridge to be stored, held between the thumb and the index finger of the other hand, can thus be slid below the lips and easily introduced into the loader.

In addition to the drawbacks already mentioned relative to the push button, this storage tool, however, does not eliminate all risk of a false maneuver, and it can be forgotten or lost due to its nature as a separate, additional tool and furthermore, it does not dispense one from the necessity of introducing the cartridges one by one into the loader.

In order to avoid this need of filling the cartridges one by one, a removable magazine which is independent of the magazine of the loader has been created in order to be able to fill the latter with all its cartridges by a single push of one hand while the other hand holds the loader. There is concerned here a removable magazine or "clip" which is particularly suitable for a loader which is wider than it and in which the cartridges are stored not one on top of the other in the same plane as in this clip but, on the contrary, staggered, by lateral offset of one with respect to the other, which permits the clip to be introduced between the lips of this loader. This clip has a lateral opening which allows all of the cartridges to be seen and makes it possible to push them manually so as to transfer them into the loader. The operation is very fast and this clip is then withdrawn and discarded, or else kept in order to be reloaded and reused subsequently.

The advantage produced by this clip is, however, limited in its application to said type of loader alone. It furthermore does not eliminate all risks of improper transfer, resulting in the falling of the loader, since it is necessary to present the clip correctly and align it well with respect to the loader at the start of the transfer operation, avoiding any skewing.

Finally, between the time of its filling and the time of its use, a loaded loader has no protection against the possible action of outside contaminating agents such as dust, sand and water.

SUMMARY OF THE INVENTION

The cartridge packing in accordance with the invention, the pack of the type comprising at least one container element filled with a given number of cartridges and at least one closure element for said container element, serves the purpose of avoiding all of the aforesaid drawbacks inherent in the operation of transferring cartridges into a loader which is removable from an automatic or semiautomatic firearm.

For this purpose, this packing is characterized by the fact that the container element is formed by an operational loader filled with cartridges and having, in known manner, a magazine, a spring, a piston and lips for the retaining and guiding of the stored cartridges, and by the fact that the closure element is formed by a protection piece which is associated by detachable connecting means with the cartridge-filled operational loader and at least a part of which is rigid and covers at least the region of the first cartridge and the lips of the loader.

In this way, the fastidious and laborious operations of transferring the cartridges into a removable loader which is suitable for the firearm of the marksman are eliminated, since the cartridge packing thus made available to him comprises this loader itself which is already filled with its cartridges. The risk of damage to the region of the first cartridge and the lips of the loader which is inherent in these transfer operations is thus also eliminated, for the same reason, with, furthermore, the advantage of permanent protection of these elements from impact during the transportation of such a packing and until the moment preceding its introduction into the firearm by the marksman, the latter having to detach the protection piece only at that time; the advantage of this packing in a combat situation can thus easily be imagined.

Finally, such a design of the cartridge packing makes it possible at the same time to assure protection against attack by one or more external contaminating agents during its transportation due to the type of connection selected between the protection piece and the loader and in accordance with the degree of their tightness.

Other advantages permitted by this basic design will become clearly evident from the following description.

BRIEF DESCRIPTION OF THE DRAWINGS

The accompanying drawing shows, by way of example, three embodiments of the object of the invention, as well as a variant of the third embodiment.

DETAILED DESCRIPTION OF THE PREFERRED EMBODIMENT

Figures 1, 2, 3, 4, 5, 6, 7:
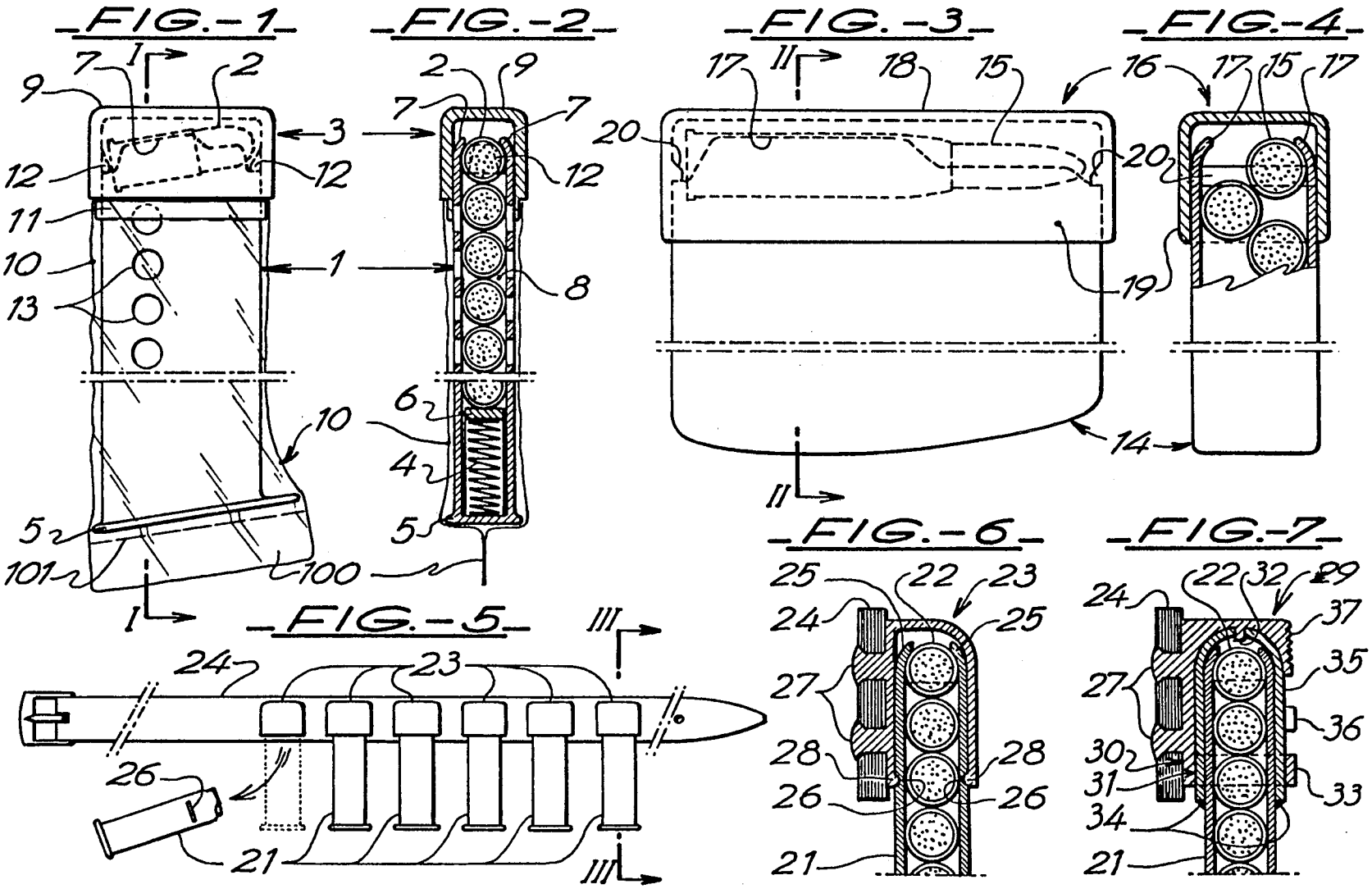
FIG. 1 is a partial elevation of the first embodiment.
FIG. 2 is a section along the section line I—I of FIG. 1.
FIG. 3 is a partial elevation of the second embodiment.
FIG. 4 is a partial section along the section line II—II of FIG. 3.
FIG. 5 is a partial elevation of the third embodiment.
FIG. 6 is a partial section along the section line III—III of FIG. 5.
FIG. 7 is a partial section through the variant.

In its first embodiment, shown in FIGS. 1 and 2, the cartridge packing of the invention is suitable for a pistol.

This cartridge packing is formed of an operational loader 1 filled with cartridges 2 and of a protection piece 3.

The operational loader 1 comprises, in customary manner, an inner spring 4 which rests against the bottom 5 of the loader, a piston 6, and two lips 7 for the retaining and guiding of the cartridges 2 which are stored in a container 8 of the loader constituting a magazine, these cartridges 2 being held, pressed against each other, one after the other, in the same plane, the first being pressed against the lips 7, by continuous push of the spring 4 against the piston 6.

The protection piece 3 is formed here by the assembly of a rigid cap 9 and a bag of transparent, flexible material 10 fastened, for instance, by gluing on a collar 11 of the cap 9.

The rigid cap 9 freely covers, without clamping, the region of the first cartridge 2 and the lips 7 of the loader 1, and it rests via two smaller inner stops 12 against two parts of the edge of the open end of the loader in order to prevent it from coming against these protected zones in case of impact.

The bag entirely covers the rest of the body of the loader and constitutes here the detachable means for the connecting of this protection piece 3 to the operational loader 1 filled with cartridges 2.

In order to obtain this result, the bag 10 is formed here by heat-sealing under pressure of its lower end 100, and this end is sufficiently wide to form an attachment strip which is easily made tearable by a tear line 101, which is obtained by a reduction in the thickness of the wall of the bag, for instance by means of a shaping tool, and is located on the edge of said strip 100.

The assembly consisting of the cap 9 and the bag 10 thus forms a tight enclosure for the protection of the loader 1 and its contents from any outside contaminating agent.

It is also possible to eliminate any risk of interior contamination due to condensation by placing said enclosure under a vacuum, for instance during the operation of the closing of the bag 10 by heat-sealing, as is current practice in other fields, such as the placing of bags of foodstuffs under vacuum.

This first embodiment is suitable for a non-tight loader 1, such as, for instance, provided here with viewing holes 13 or else the bottom 5 of which is removable, which, however, must be protected against all exterior and possibly interior contaminating agents.

A marksman who has such a package of cartridges need merely, prior to the loading of his firearm, tear the detachable strip 100 and allow the loader 1 to fall into his hand, the loader freeing itself by simple gravity from the enclosure formed by the cap 9 and the bag 10, and this both when this enclosure is under vacuum and when it is not.

Upon practice firing, one or more cartridge packings formed in this manner can be carried by the marksman, for instance in a case, which he could fasten to his belt, or else placed in loops or clamps forming part of his belt or of his harness.

The materials used for the manufacture in the factory of the cap 9, of the protection piece 3, and of the body of the operational loader 1 may be of any kind which is sufficiently rigid to assure their functions.

Since the marksman is freed from the operation of filling the loader, which also is to be done in the factory, it goes without saying that an empty loader is no longer of any interest with respect to the purpose of the invention and can be thrown away after use. The selection of the material and of the method of manufacture of these parts is therefore essentially based on the cost price; in accordance with this criterion, one can contemplate, for instance, the use of a suitable plastic material, whether or not reinforced with fiberglass or carbon, and formed, in mass-production, by molding.

It is also possible and advantageous to develop the loader of transparent plastic material when it is believed useful to make the number of cartridges remaining in the loader during firing visible, which avoids the provision of viewing holes 13.

Furthermore, due to the fact that the loader of the packing can be thrown away after use and therefore need no longer be disassemblable for cleaning, it is possible to make it in a single piece, without any opening other than the opening in its upper end having the lips 7. In this case, the bottom 5 can be attached and glued or welded to the body of the loader after the introduction of its cartridges and of its functional parts in the factory.

In the second embodiment, shown in FIGS. 3 and 4, which has substantially the same advantages of use as the preceding one, the cartridge packing is suitable for the feeding of a rifle.

This cartridge packing is formed here also of an operational loader 14 filled with cartridges 15, and of a protection piece 16.

The operational loader 14 is of the type in which the cartridges 15 are arranged staggered by lateral offset of one with respect to the other, as can be clearly noted from the sectional view of FIG. 4; it also has, in customary manner, an inner spring and a piston (which are not visible in the drawing) and two lips 17 for the retaining and guiding of the stored cartridges 15. The walls of this loader 14 have no opening other than the opening at the end having the lips 17.

The protection piece 16 is formed here by a single-piece cap 18 fitted by clamping on the upper part of the periphery of the loader 14 over a height sufficient not only to cover the region of the first cartridge 15 and the lips 17 but also to assure sufficient holding by its inherent elasticity, its side wall 19 thus constituting the detachable means for the connecting of this protection piece 16 to the operational loader 14 filled with cartridges 15.

This protection piece 16 is provided here also, and for the same purpose of safety as in the first embodiment, with two inner lateral stops 20 resting on two parts of the edge of the open end of the loader.

This second embodiment has, as compared with the first, a simplified means of detachable connection between the operational loader 14 and the protection piece 16, which is suitable to assure effective protection against dust but which is, however, less satisfactory with respect to moisture due to possible buckling between the walls in contact.

The effectiveness of this type of connection by elastic clamping can be easily modulated by selection of the elastic pressure and the nature of the surface of the walls in contact.

In its third embodiment, shown in FIGS. 5 and 6, the cartridge packing is suitable preferably for the feeding of an assault rifle or a pistol shooting in bursts, intended for proximity combat.

This cartridge packing is formed of a plurality of identical operational loaders 21, in this case six, filled with cartridges 22, and of a corresponding number of protection pieces 23 which in this case are associated by attachment to a belt 24, the loaders 21 and then the belt 24 being adapted to be thrown away after use.

The structures of this packing are developed at the same time to facilitate the maneuver of grasping and detaching the loaders from the belt and making it as rapid as possible, and to assure effective protection of the loaders when transported from the weather and the violence of the stresses inherent in situations of this type of combat.

The operational loaders 21 comprise, in customary manner, in this case also an inner spring and a piston, not visible in the drawing, and two lips 25 for the retention and guiding of the stored cartridges 22.

The body of each loader has no opening other than that at its end which has the lips 25, but on the other hand it has two recessed grooves 26 on two opposite outer faces which are intended for its connection to the corresponding protection piece.

The protection pieces 23 are formed by single-piece caps covering the upper part of the loaders 21 and each having, on a wall applied against the belt 24, two studs 27 engaged and riveted in two corresponding holes in the belt, as well as two protruding inner beads 28 at the open end of two opposite walls, which beads are engaged elastically, by pressure of these two walls against the two corresponding walls of the loader 21, into the two above-mentioned recessed grooves 26 in these last two walls.

The height of covering the loaders 21 by the caps 23 is established here also so as both to protect the region of the first cartridge 22 and the lips 25 and to assure sufficient holding of the loaders 21 with respect to the contemplated stresses, while permitting sufficiently easy release by means of a single hand.

The detachable connecting means between loaders and caps results here from the combination of the elastic clamping of the walls in contact and the interpenetration of these elements in each other obtained by the engagement of the beads 28 of the caps in the grooves 26 of the loaders.

However, the detachable connecting means between the loaders 21 and their caps 23 can be developed in another manner and offer the advantage of perfect tightness and total protection from contaminating agents both on the outside and on the inside.

The variant shown in FIG. 7 illustrates this possibility.

In this variant, unchanged elements bear the same reference numbers, such as the loader 21 with its cartridges 22, the belt 24, and the studs 27.

The protection piece, which in this case bears the reference number 29, is developed in two parts which are partially inserted and fitted in each other and are formed of a holding piece 30 having the studs 27 for attachment to the belt 24 and a cap 31 which covers the upper part of the loader 21 which has the lips 25, the body of the loader being furthermore tight.

The holding piece 30 comprises a cover tongue 32 for covering a corresponding orifice in the upper part of the cap 31, and a lower belt 33 closely encircling the body of the loader 21.

The connection and tightness of the cap 31 with the loader 21 are assured, at the level of the interface of these elements, by a layer of varnish 34 of known type suitable, on certain cartridges, to assure tightness between the projectile and the case.

On its outer face 35 and between the lower belt 33 and the top part of the holding piece 30, the cap 31 has a stop 36 spaced above the lower belt 33, the vacuum being produced within the enclosure formed by the elements of the packing thus formed and maintained by the cover tongue 32.

A marksman equipped with a cartridge packing of this type need only pull the body of the loader downward.

Upon this movement, the loader 21 first carries along the cap 31 which is attached to it by the varnish 34 and this cap frees itself from the cover tongue 32, which has the effect first of all of allowing air to penetrate into the inner space between the two parts 30 and 31 of the protection piece 29 and into the loader 21. Thereupon, and in this same movement, the stop 36 of the cap 31, which is still connected to the loader by the varnish 34, comes against the lower belt 33 of the holding piece 30, which has, as second effect, the breaking of this layer of varnish, permitting the loader to free itself from the cap 31.

The loader can then be put in place in the firearm without any intermediate operation.

In a combat situation and in case of imminent firing, the marksman can first of all release the cover tongue 32 so as to permit the air to penetrate, for instance by pivoting the upper part of the holding piece 30 upward and breaking it off. In order to facilitate grasping for this operation, the holding piece 30 may have striations 37 on its front part.

Of course, the embodiments shown by way of example are not limitative and changes can be made in accordance with specific requirements.

Thus, first of all, for one and the same type of loader, all the embodiments shown of the protection piece can be applied.

Variants (not shown) of the detachable means of connection between loader and protection piece can also be applied, for example the type of known connection by tear strip used for certain plastic bottle stoppers.

In the first embodiment, when placing under vacuum is not deemed indispensable, the bag 10 can be provided only in the form of a tight bag of tearable material, without tear strip or line 100-101, which marksman tears upon pulling the cap 9, subject then to freeing what may remain of this bag around the loader 1.

The tightness means shown need not necessarily be assured, as, for instance, in the case of a packing intended preferably for firing practice. In that case and for the first embodiment, for instance, the tight bag 10 can be eliminated and the connection between the cap 9 and the loader 1 can be assured by simple pressure of the contacting walls of these two parts.

Nor is it indispensable to provide inner safety stops such as the stops 12 (FIG. 1) and the stops 20 (FIG. 3). It is, in fact, possible to impart to the ceiling of the protection piece a curvature similar to that of the lips of the loader and bearing against the latter over their entire width, the contact surfaces thus obtained between these parts being sufficiently large to offer sufficient resistance to deformation stresses resulting from impacts.

The belt 24 of the third embodiment can be replaced by any other support worn by the marksman, such as, for instance, a bandolier.

In this third embodiment, a single bead 28 can be provided, engaged in a single corresponding groove 26 of the loader 21, which manner of connection can furthermore be used by itself, without combination with an elastic clamping of their contact walls, in another embodiment, which has not been shown.

In conclusion, it will be noted that two or more loaders can be placed against each other in detachable manner, for instance by association of their protection pieces on a common assembly, which assembly can, furthermore, in its turn be associated with a support worn by the marksman.

I claim:

1. A cartridge packing for automatic or semiautomatic firearms comprising at least one operational loader (1, 14, 21) filled with cartridges and having a magazine, a spring, a piston, and lips for retaining and guiding the cartridges stored, and a protection piece (3, 16, 23, 29) comprising a rigid cap covering the region of the first cartridge and the lips of the loader, and a flexible, tight, tearable bag (10) entirely covering the rest of the loader, said bag (10) detachably connecting the rigid cap to the loader.

2. A packing according to claim 1, characterized by the fact that the bag (10) of the protection piece (3) (1) comprises a closure and grasping strip (100) defined in part by a tear line (101) located adjacent an edge of said strip for enabling separation of said strip and opening of said bag.

3. A packing according to claim 1, characterized by the fact that it comprises a plurality of operational loaders (21) filled with cartridges (22), and a corresponding number of protection pieces (23), the latter being associated by attachment to a common support (24) capable of being worn by a marksman.

4. A packing according to claim 1, characterized by the fact that the assembly consisting of the loader (1, 21) and the protection piece (3, 29) forms a tight vacuum enclosure.

5. A packing according to claim 4, characterized by the fact that the bag (10) of the protection piece (3) (1) comprises a closure and grasping strip (100) defined in part by a tear line (101) located adjacent an edge of said strip for enabling separation of said strip and opening of said bag.

* * * * *